US005282331A

United States Patent [19]

Fell

[11] Patent Number: 5,282,331

[45] Date of Patent: Feb. 1, 1994

[54] DISPLAY MODULE

[75] Inventor: Michael J. Fell, Bryn Mawr, Pa.

[73] Assignee: M & M Displays, Inc., Philadelphia, Pa.

[21] Appl. No.: 901,561

[22] Filed: Jun. 19, 1992

[51] Int. Cl.[5] ..... G09F 7/22

[52] U.S. Cl. ..... 40/617; 40/553; 362/223; 362/812; 52/39

[58] Field of Search ..... 40/553, 559, 611, 617, 40/560; 362/150, 223, 812; 52/38, 39

[56] References Cited

U.S. PATENT DOCUMENTS

| | | | |
|---|---|---|---|
| 3,984,931 | 10/1976 | Belokin, Jr. . | |
| 4,075,775 | 2/1978 | Shorette | 40/553 |
| 4,136,474 | 1/1979 | Belokin, Jr. | 40/559 |
| 4,229,913 | 10/1980 | Corrigan | 40/617 X |
| 4,290,218 | 9/1981 | Drueck, Jr. | 40/553 |
| 4,528,764 | 7/1985 | Cobb | 40/553 |
| 4,564,165 | 1/1986 | Grant et al. | 52/39 X |
| 4,716,671 | 1/1988 | Gross | 40/558 |
| 4,856,216 | 8/1989 | Gross | 40/559 |
| 4,947,570 | 8/1990 | May et al. | 40/553 |
| 5,128,850 | 7/1992 | Juodvalkis | 362/812 X |

*Primary Examiner*—Brian K. Green
*Attorney, Agent, or Firm*—Volpe & Koenig

[57] ABSTRACT

A display module for attachment to the framing members adjacent a lighting fixture. The module is comprised of a light transmissive trough which is suspended beneath the lighting fixture and receives its light from the fixture without substantially impairing the illumination available to the area beneath the light fixture. The modules may be used individually or combined with other modules to create different geometric patterns of display.

1 Claim, 8 Drawing Sheets

DISPLAY MODULE

BACKGROUND OF THE INVENTION

1. Field of the Invention

The present invention relates to a modular ceiling display. More particularly, it relates to a display module for suspended ceilings which is attached beneath the perimeter of an overhead lighting fixture. The indicia on the display is illuminated by light from the fixture without interruption of the illumination from the center of the fixture.

2. Description of the Prior Art

Overhead displays which are attached under flush-mounted florescent lighting fixtures of the type commonly used in conjunction with suspended ceilings are known in the art. Such displays are known for use in retail stores for both product advertising and location within the store. A number of prior U.S. patents are directed to this field.

A lighted advertising display panel is disclosed in U.S. Pat. No. 4,290,218. The display panel is co-extensive in area with a standard suspended ceiling tile and is substituted for a ceiling tile at a desired location.

U.S. Pat. No. 4,528,764 discloses a suspended ceiling sign which is mounted under an overhead lighting fixture as a substitute for the original diffuser. The sign is co-extensive with the existing overhead lighting fixture and includes reflective elements which direct the light toward the display panels.

U.S. Pat. No. 4,947,570 discloses a display unit, having at least five (5) translucent panels on which messages can be printed, which is assembled to provide a total light enclosure. The display unit may be shipped in a collapsed condition, assembled and installed at a given site. The assembled unit fits into the support grid of a suspended ceiling under a standard florescent light fixture. Once again, the display unit is co-extensive with the light fixture.

While the displays disclosed in the above prior art are all adapted for attachment under standard florescent lighting fixtures, they tend to limit the light available from the fixture and to be bulky to install.

Since the present module is not as bulky as other display units known in the art, the disclosed module is more easily positioned and provides increased flexibility. In multi-display arrangements, the display modules can be installed individually.

Because the modules cover only a narrow portion of the perimeter of a light fixture, the fixture provides illumination for the display and the area below.

It is an object of this invention to provide a display module which may be installed without any modifications and/or changes to the ceiling grid members or the lighting fixture in the ceiling.

It is an object of this invention to provide a display module which may be installed with other modules to provide an expanded display.

It is an object of this invention to provide a display module which receives its lighting from the lighting fixture with virtually or no loss of light to the area beneath the fixture.

SUMMARY OF THE INVENTION

The present invention provides a display module for attachment to the framing members adjacent a lighting fixture. The modular display is comprised of a closed-end light transmissive trough. Co-planer flanges extend from the end panels and at least one edge of the trough for attachment to the framing members adjacent a lighting fixture. A single display or a plurality of displays may be used with one or more edges of a given light fixture. Multiple display modules can be used to span multiple light fixtures in a bank of lights.

Indicia may be printed on the light transmissive trough or on interchangeable display panels which are releasably retained against the trough. A means for suspending a sign or banner from the display module can be incorporated in the lower support.

A single module or a plurality of modules may be attached to the edges of the light fixture or fixtures using the same form of clip. In multi-display arrangements, the universal clips are used to attach the abutted ends of the display modules together.

DESCRIPTION OF THE PREFERRED EMBODIMENTS

Figure 1:
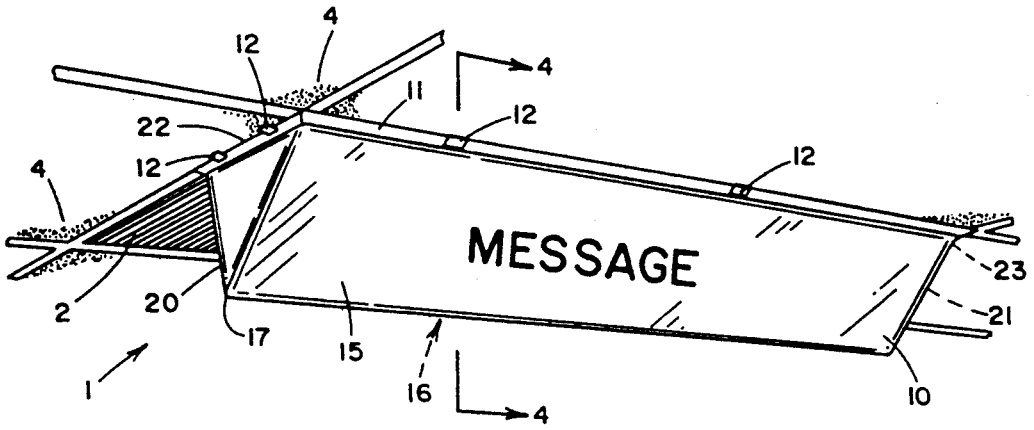
FIG. 1 is a perspective view of a first embodiment of an installed display module.

The preferred embodiments will be described with reference to the drawing figures wherein the same numeral indicates a like element throughout.

Referring to FIG. 1, there is shown a first embodiment 1 according to the invention installed beneath an overhead lighting fixture 2 in a suspended ceiling 4. The suspended ceiling 4 is comprised of a framework of regularly spaced grid members 3 which create light fixture and ceiling tile receiving areas. Located in the respective areas are ceiling tiles 6 and the overhead light fixture 2. Generally, the receiving areas will have a lengthwise axial dimension of four feet and a widthwise axial dimension of two feet. In some instances, the axial dimension are equal. However, the sizes of the receiving areas are generally the subject of standardized building codes and/or are related to commercially available tiles and fixtures.

Module 1 is comprised of a trough 10 made of a light transmissive material. The trough has a long, narrow body comprised of face panels 15 and 16 and end closures 20 and 21 which are normal to the face panels 15 and 16. In this embodiment first face panel 15 is angled out at approximately thirty degrees (30°) from the vertical and the second face panel 16 is angled out at approximately seven degrees (7°) from the vertical. The face panels 15 and 16 are joined by and are integral with bottom 17. The end closures 20 and 21 generally form obtuse triangles. If desired, an advertising message or the like can be imprinted upon face panels 15 and 16.

Still with reference to FIG. 1, flanges 22, 23 and 11 extend outward from the top edges of the end closures 20, 21 and the first panel 15. All of the flanges 11, 22 and 23 are coplanar. The flanges are provided as the attachment areas for securing the module to the frame or grid member 3. A plurality of universal clips 12, shown more particularly in FIG. 1, secure the module to the grid members 3.

Figure 4:
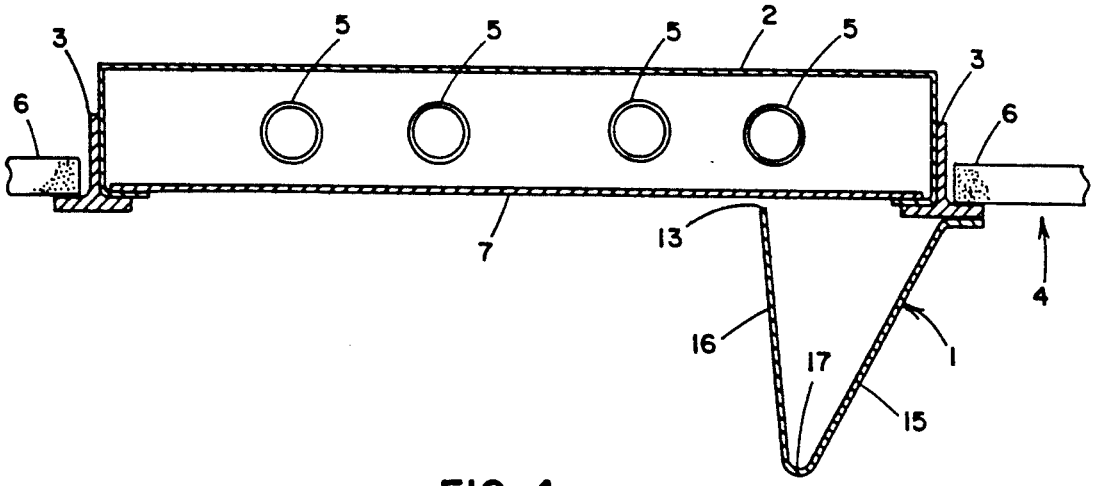
FIG. 4 is a section along line 4—4 in FIG. 1.

As can be seen in FIGS. 1 and 4, the module 1 is substantially narrower than the overhead lighting fixture 2 and covers only a portion along the edge or perimeter thereof. The width of trough 10 is such that its inboard edge 13, when placed parallel to the florescent tubes, lies directly below an outer florescent tube 5. This relationship is shown in FIG. 4 for a conventional four tube florescent light fixture. Light from the tubes provides back lighting for the face panels 15 and 16. The majority of the fixture's light passes through diffuser 7 and remains unshielded. Thus, the normal light path for light through the center of the fixture is undisturbed and the principal source of light for the module is light which normally angles away from the fixture or is reflected within the fixture.

Figure 2:
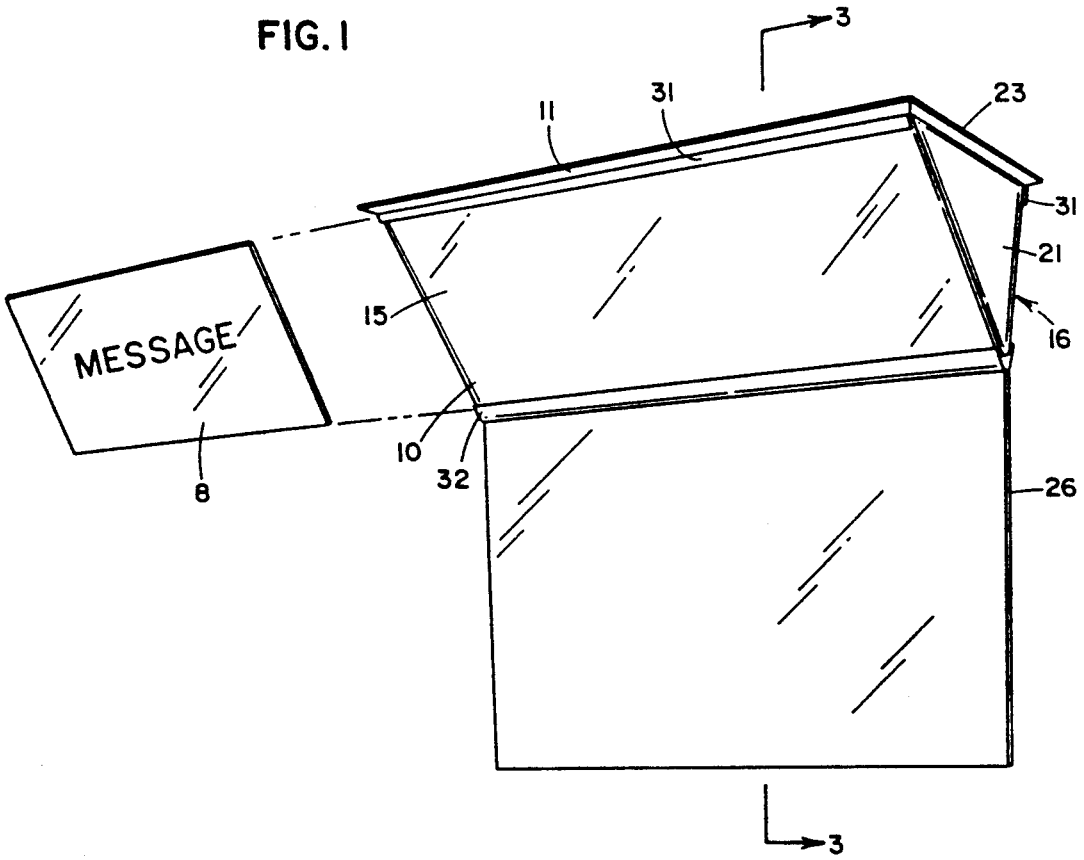
FIG. 2 is a perspective view of the first embodiment with a suspended sign and an interchangeable display panel.
Figure 3:
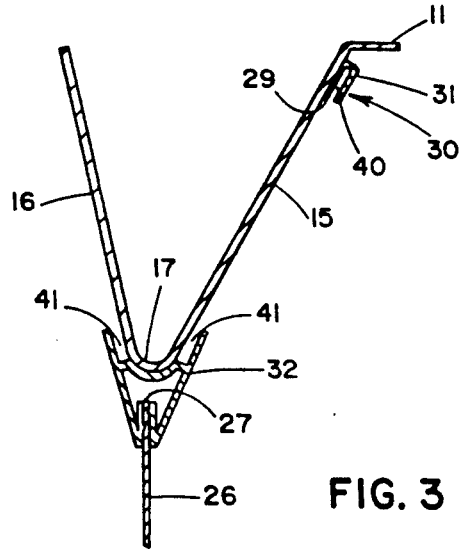
FIG. 3 is a section along line 3—3 in FIG. 2.

FIGS. 2 and 3 show the module 1 with optional upper and lower panel supports 31 and 32 and an interchangeable panel 8. The upper support 31 may be attached along the upper edges of either one or both of the face panels 15 and 16. The upper support 31 is preferably a resilient thermoplastic material formed into a "J" shape with the opening being disposed downwardly along the face panel 15 or 16. The "J" is closed by about five degrees to form channel 40 with a wedge-shaped profile approximately 0.11 inches wide at the base and 0.08 inches wide at the top or opening. The resilient short leg 30 biases the panel 8 to one side of the channel 40 to secure it in place.

Figure 11:
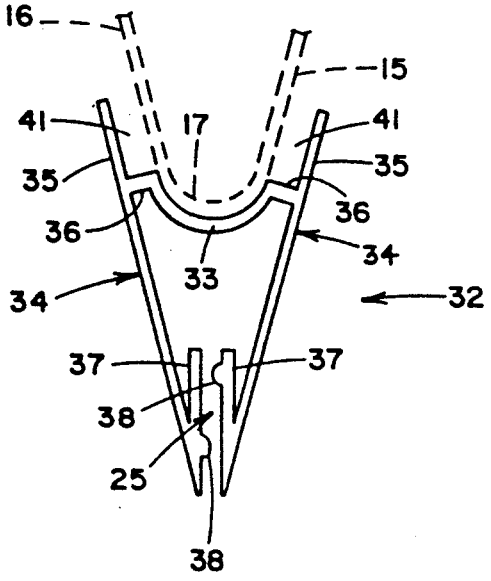
FIG. 11 is an enlarged section of a first embodiment of a lower panel support.

The lower support 32, shown more clearly in FIG. 11, has a base 33 radiused to complement the radiused bottom 17, shown in phantom, of the trough 10. Shoulders 36 extend from the face 33 and support the arms 34. Each shoulder 36 is angled down and in toward base 33. A portion 35 of each arm 34 extend upwardly and generally parallel to the associated face panel 15 and 16 and forms therewith the channels 41.

The lower portions of the arms 34 extend inwardly toward each other and terminate approximately 0.06 inches from each other to form the channel 25. Vertically disposed on either side of channel 25 is a resilient flange 37. Non-aligned projections 38 protrude, approximately 0.03 inches, from each flange 37 into the channel 25 between the flanges 37. This forms a serpentine path in the channel 25.

The same lower support 32 can be used for a range of different trough angles by shifting the base 33 relative to the trough bottom 17. This shifting helps to maintain the vertical positioning of flanges 37. The upper portions 35 may no longer be precisely parallel to the face panels 15 and 16, however, the channels 41 will still be of sufficient size to accommodate the interchangeable panel 8. With reference to FIG. 2, the interchangeable panel 8 can be slidably inserted into the channels 40 and 41 formed by the upper and lower supports, 31 and 32. By sizing panel 8 according to the distance between channels 40 and 41, the panel can be securely held. Thus, the shifting of base 33 will not adversely effect the panel's security.

Referring again to FIGS. 2 and 3, there is shown a panel 26 which is suspended beneath the module 1. Panel 26 has an upper edge 27 which has been inserted into the serpentine path formed by flanges 37 and projections 38. Panel 26 is preferable thicker than the channel 25 and is retained by the serpentine path, the resilient action of the cooperating flanges 37 acting against the panel 26 and the resilient action of the lower portions of arms 34 which continue to be biased toward each other.

Figure 5:
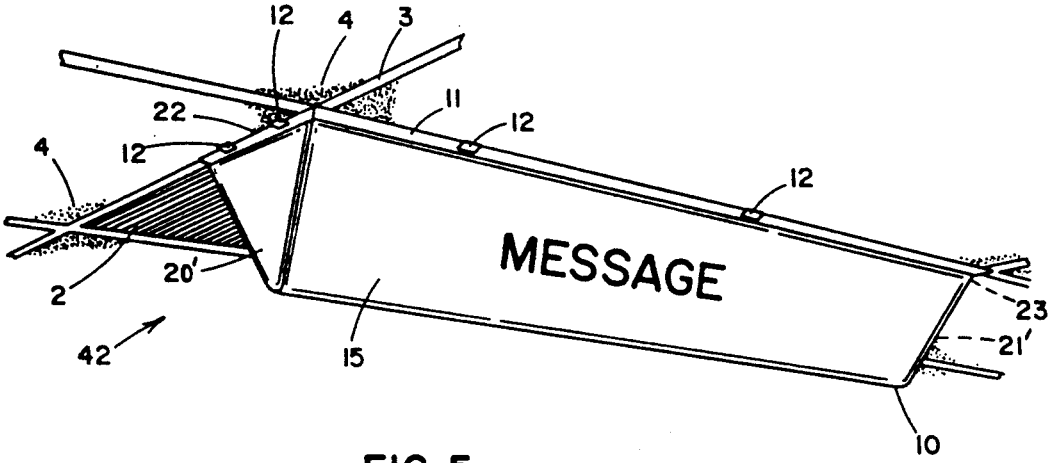
FIG. 5 is a perspective view of a second embodiment of an installed display module.
Figure 6:
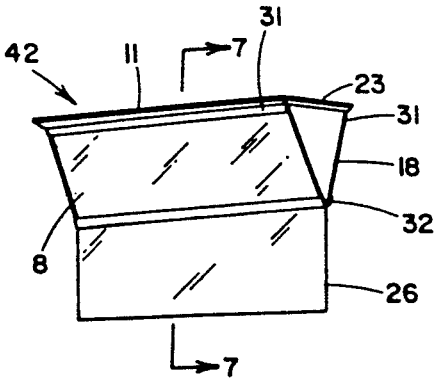
FIG. 6 is a perspective view of the second embodiment with a suspended sign and an interchangeable display panel.
Figure 7:
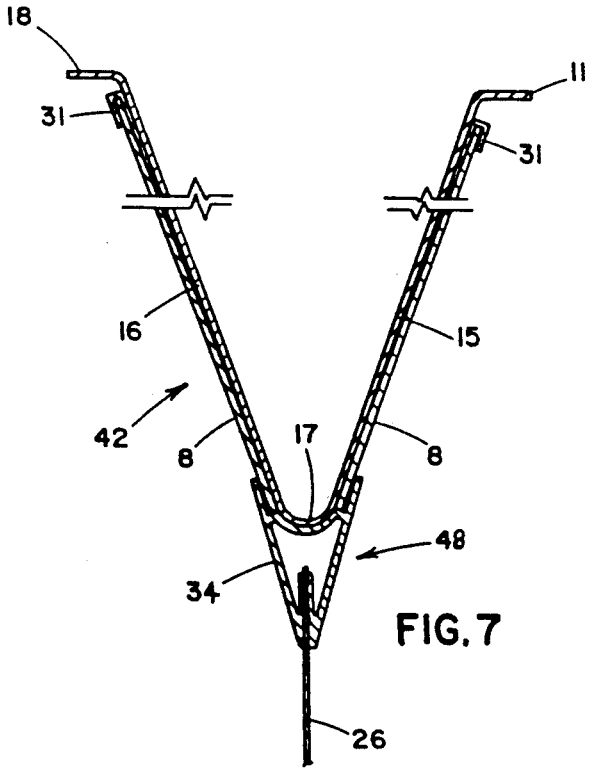
FIG. 7 is a section along line 7—7 in FIG. 6.

A second embodiment of the display module 42 is illustrated in FIGS. 5 through 7. The module 42 is substantially similar to the previously described module 1, except the face panels 15 and 16 are each angled out at approximately twenty degrees (20°) from the vertical. This provides equal visibility of the module face panels from both directions. The end closure 20' and 21' generally form isosceles triangles. Additionally, a flange 18 has been added along the edge of face panel 16. The flange 18 extends outward and is coplanar with flanges 11, 22 and 23. This allows the module 42 to be installed with either face panel 15 or 16, adjacent to the ceiling grid member 3.

Figure 12:
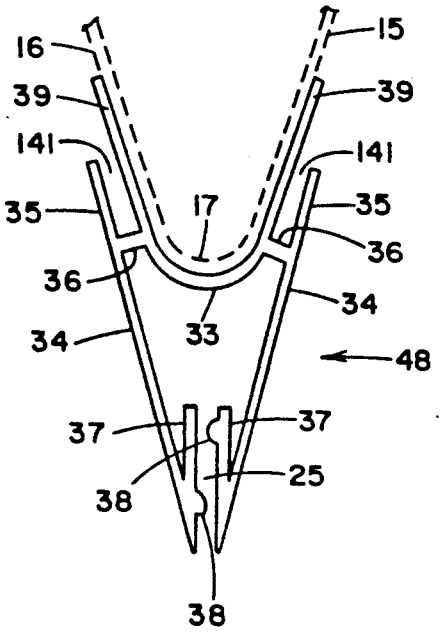
FIG. 12 is an enlarged section of a second embodiment of a lower panel support.

A second embodiment of a lower support 48 is also shown in FIGS. 5 through 7. Support 48, shown more clearly in FIG. 12, is similar to the previously described support 32, except that arms 39 extend up from the ends of the base 33 parallel to the face panels 15 and 16, shown in phantom. The length of shoulders 36 is adjusted to maintain the size of the channel 141. The arms 39 and the base 33 contact the bottom 17 and the face panels 15 and 16 and provide an increased bonding area. Additionally, the upper portion 35 of arms 34 are set at a five degree closed angle relative to the respective arms 39, forming channels 141 with a wedge-shaped profile similar to the profile of channels 40 formed by the upper support 31 as previously described. The resilient arm 39 biases the panel 8 to one side of the channel 141, providing additional means to secure the panel 8 in combination with the action of the upper support 31.

Figure 8:
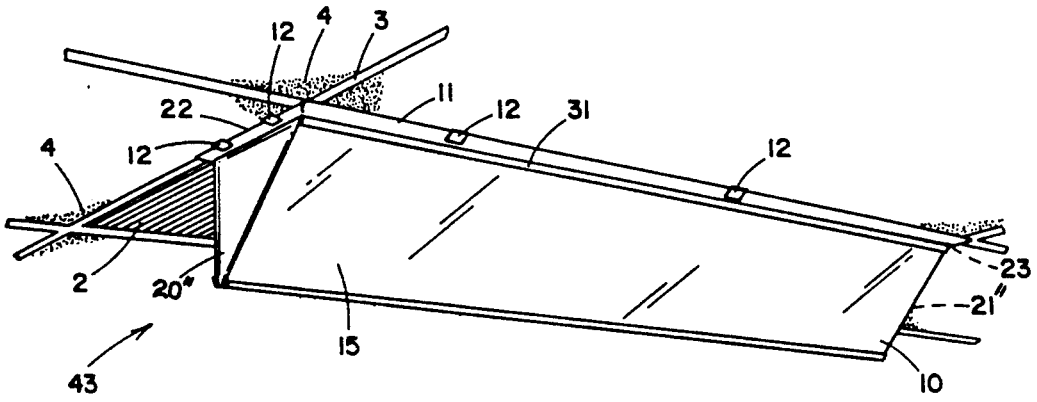
FIG. 8 is a perspective view of a third embodiment of an installed display module.
Figure 9:
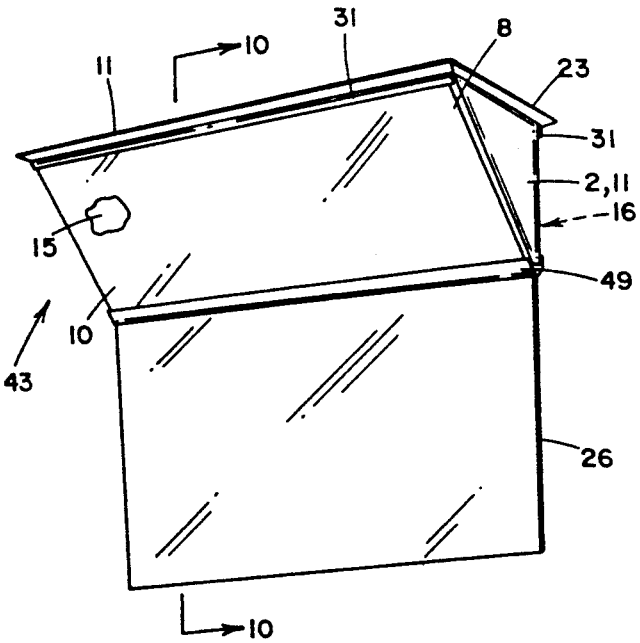
FIG. 9 is a perspective view of the third embodiment with a suspended sign and an interchangeable display panel.
Figure 10:
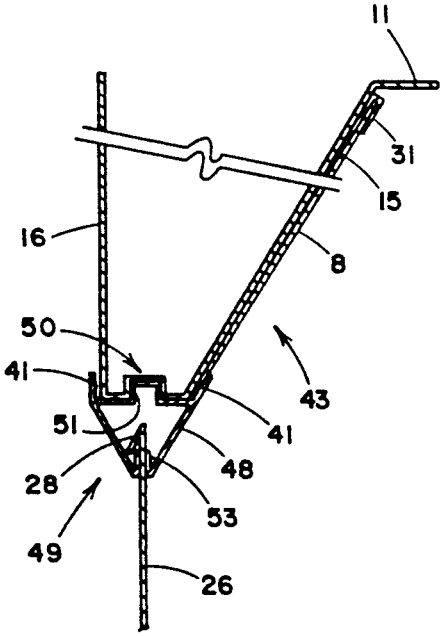
FIG. 10 is a section along line 10—10 in FIG. 9.

A third embodiment of the display module 43 is illustrated in FIGS. 8 through 10. This embodiment is particularly adapted for use on light fixtures located along a wall where visibility from only one direction is desired. Module 43 is substantially similar to the previously described module 1, except the first face panel 15 is angled out approximately forty five degrees (45°) from the vertical, and the second face panel is vertical. The end closures 20' and 21' generally form right triangles, see FIG. 8. This embodiment illustrates an alternate "W"-shaped bottom 50 which extends between and is integral with the face panels 15 and 16, see FIGS. 9 and 10.

Figure 13:
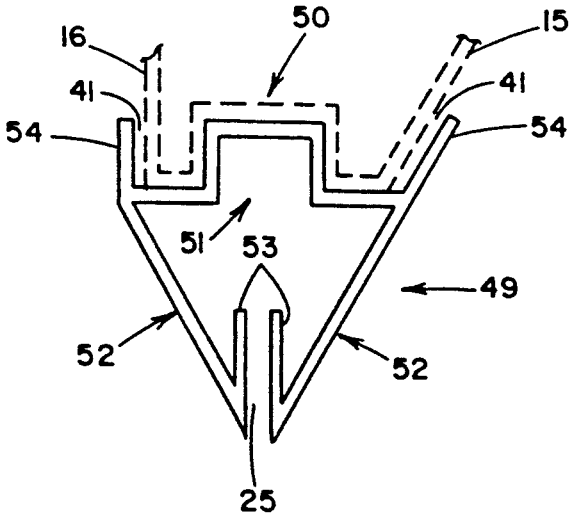
FIG. 13 is an enlarged section of a third embodiment a lower panel support.

Referring to FIGS. 10 and 13, the panel support 49 and the bottom 50 will be described in more detail. The support 49, shown clearly in FIG. 13, is comprised of a base projection 51 which match the recess in bottom 50. The upper portions 54 of the arms 52 extend above the base of projection 51 and are spaced from and parallel to the respective face panel 15 or 16, to define open channels 41. Arms 52 depend inwardly toward each other from the base of projection 51 and terminate in the channel 25. A resilient flange 53 is vertically disposed on either side of the channel 25.

Referring again to FIG. 10, there is shown a panel 26 suspended beneath the module 43. The panel 26 is inserted in lower support 49 with the hooked portion 28 engaging one of the flanges 53. As will be appreciated, projections 38 similar to those shown on the earlier embodiments can be incorporated in support 49, as desired.

Figure 14:
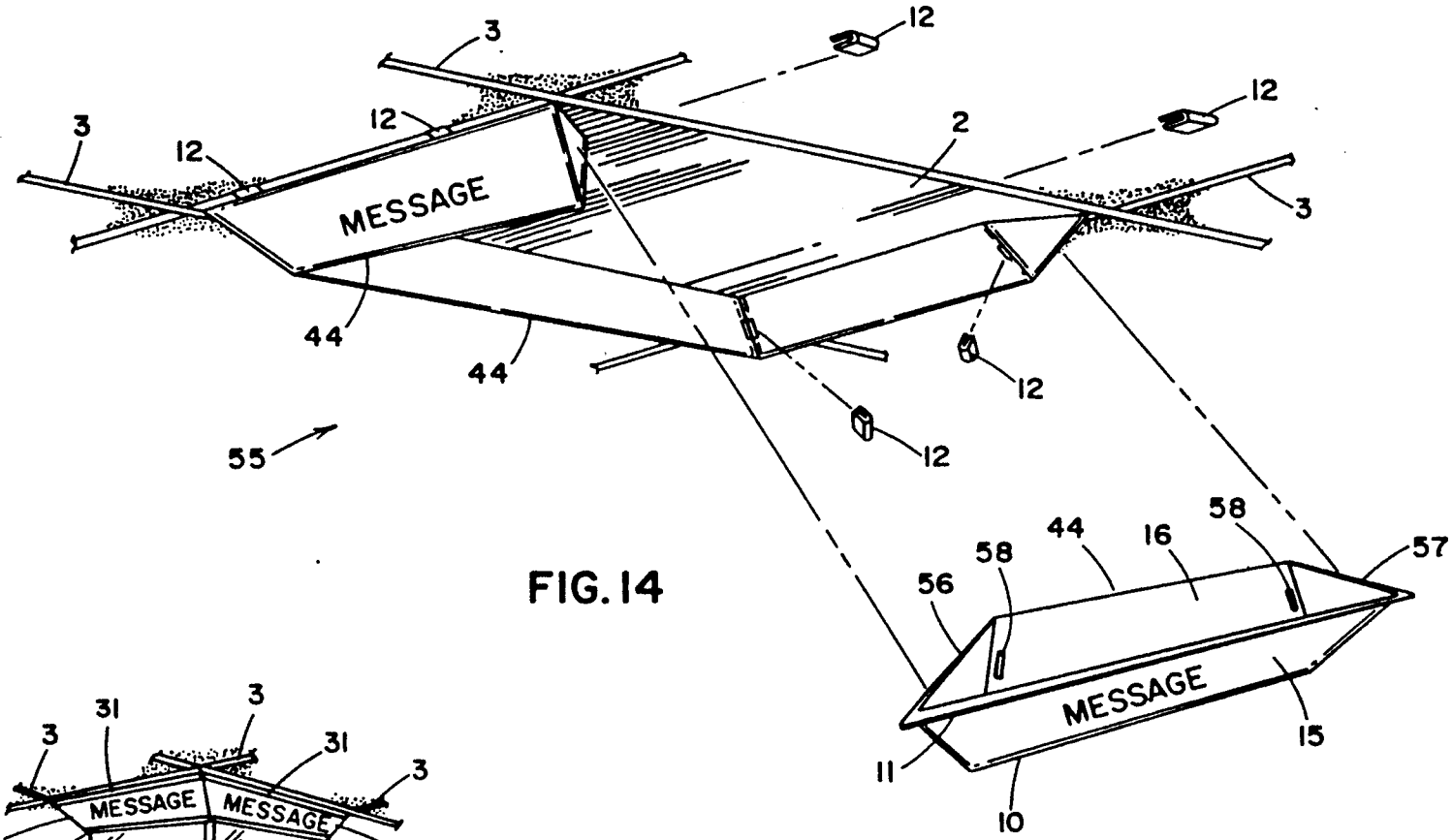
FIG. 14 is a perspective view of four display modules, according to a fourth embodiment of the invention, installed around the periphery of a single overhead lighting fixture with one module exploded out to show details of the embodiment.
Figure 15:
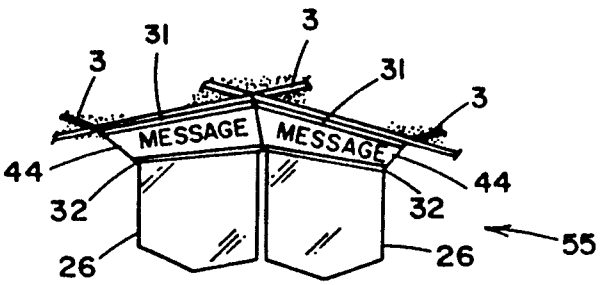
FIG. 15 is a perspective view of the fourth embodiment as shown in FIG. 14 with suspended signs and interchangeable display panels.
Figure 16:
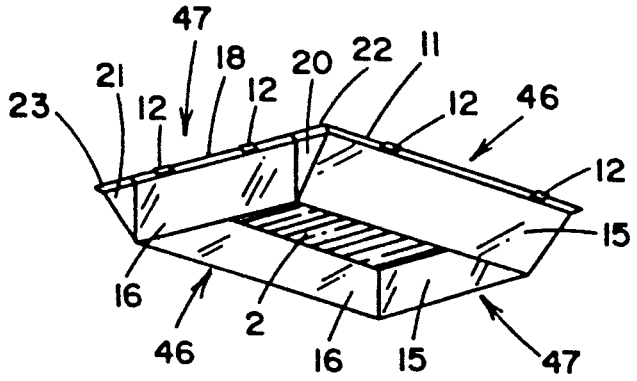
FIG. 16 is a perspective view of another embodiment having multiple modules.

FIGS. 14 through 16 illustrate the use of four (4) display modules of another embodiment on a single overhead light fixture to provide illuminated messages or advertisements that are visible from all directions. The fourth embodiment of the display module 44 will be described with reference to FIG. 14. This module 44 is substantially similar to the previously described module 1, except that end closures 56 and 57 are angled or mitered. When the end closures of intersecting modules 44 are abutted, miter joints are formed at the corners. Apertures 58 are provided in the face panels 16 adjacent to the end closures 56 and 57. Clips 12 are inserted through adjacent apertures 58 in abutting modules to secure them together.

FIG. 15 shows the fourth embodiment positioned on all four sides of an overhead lighting fixture. Upper and lower supports 31 and 32, as previously described, are provided and panels 26 are suspended therefrom.

Referring to FIG. 16, two pairs of display modules 46 and 47 are shown attached beneath an overhead light fixture. The modules 46 and 47 are substantially the same as module 43, with the addition of flange 18 along face panel 16 as previously described. The first pair of modules 46 are installed with face panels 15 and 16 and end closures 20 and 21 exposed. The second pair of displays 47 are installed exposed face panels 15 and 16, however, end closures 20 and 21 are nested behind the vertical face panels 16 of the first pair of displays 46. Clips 12 are used to secure the exposed flanges 11, 18, 22 and 23, as previously described, to the ceiling grid members 3.

As illustrated in FIGS. 14 through 16, the center portion of the lighting fixture remains uncovered. Since each module can be individually attached along an edge of the lighting fixture, the problems associated with preassembling and/or carrying a full sized display unit up to the ceiling fixture is eliminated.

Figure 17:
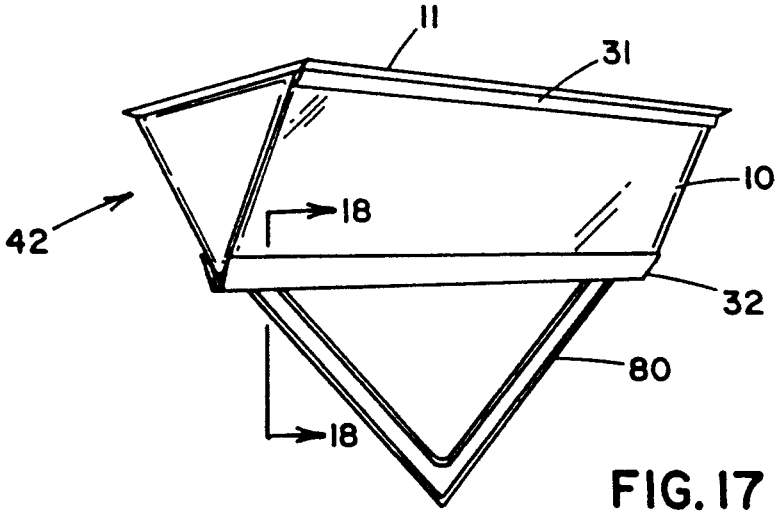
FIG. 17 is a perspective view of a module according to FIG. 6 with a suspended pointer.
Figure 18:
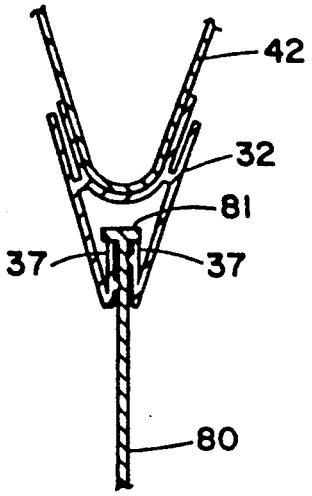
FIG. 18 is a section along line 18—18 in FIG. 17.

Referring to FIGS. 17 and 18, there is illustrated an additional feature of the present invention which permits the use of an additional indicia. In this example, a plastic pointer 80, preferably made of a translucent, neon-colored material, is suspended from the lower supports 32. The indicia has a "T"-shaped end 81 which slides into and engages channel 25, see FIG. 18.

Figure 19:
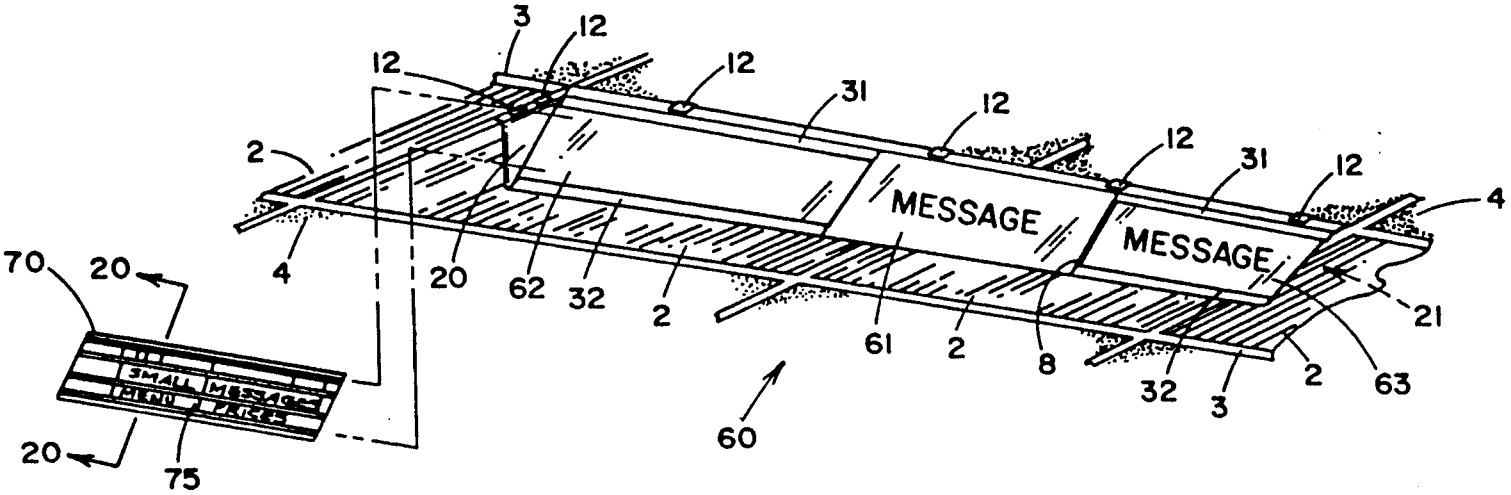
FIG. 19 is a perspective view of an extended length display module.
Figure 20:
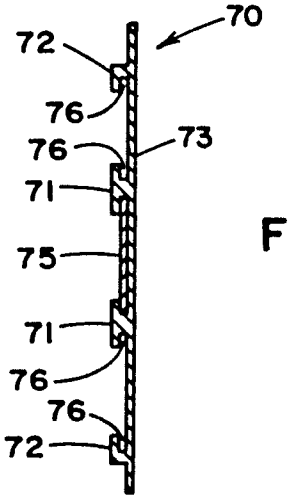
FIG. 20 is a section along line 20—20 in FIG. 19.

Referring to FIGS. 19 and 20, there is shown an extended display module 60. Display module 60 is substantially similar to the previously described module 1, except that the length of trough 10 has increased to span two lights fixtures. Clips 12 are used to attach the module 60 to the adjacent ceiling grid members 3. The module 60 is illustrated with a permanent message printed on its center section 61. End sections 62 and 63 are shown with attached upper and lower channels, 31 and 32, as previously described.

A multi-track panel 70, shown more clearly in FIG. 20, is provided as a means of retaining smaller interchangeable messages. The multi-track panel 70 is comprised of a flat base 73 with protruding "T" and "L" sections 71 and 72. The protruding sections 71 and 72 form channels 76 in which small placards 75 are inserted. The placards 75 are preferably translucent to utilize the back lighting feature of the present invention. If desired, the channel 76 may be placed directly on the face panel(s).

The display modules can be supplied in a variety of lengths to suit any fixture or arrangement of fixtures. Standard sizes are supplied in twenty-four inch and forty-eight inch lengths to match the size of conventional suspended ceiling panel or lighting fixture receiving areas. The extended length display 45 can be eight feet long or longer to extend along the edges of two or more receiving areas. The preferred trough width is in the range of 6 to 9 inches at the attachment surface. This has been found to provide good illumination for the display indicia while still providing adequate directed lighting. In general, the trough length is at least about three (3) times the width of the trough. The face panels 15 and 16 in the preferred embodiments are approximately eleven to thirteen inches wide and can be set at a variety of angles relative to each other. The upper and lower supports 31 and 32, 48, or 49 can be set at selected locations.

The modules are preferably vacuum molded or thermoformed as one piece. Alternatively, they can be assembled from pre-cut end closures and extruded panels. Acrylic resin blended with material known as DR produces as suitable starting material for the production of modules. At present, the material has a thickness of 125 mils before it is formed. During formation the material will undergo a thinning to as low as 50 mils. It has been found that the present material provides good structural stability, without brittleness, and the desired light transmission. A suitable acrylic resin is available from Rotuba Plastics of Edison, N.J.

The three disclosed embodiments of the lower indicia panel support 32, 48 and 49 are functionally equivalent, with the first embodiment 32 designed for use with a variety of trough arrangements as previously noted. The lower supports are preferably extruded from polyvinyl chloride. They are, preferably, permanently bonded or fused on the trough 10. The upper indicia panel support 31 is also preferably extruded from polyvinyl chloride. The thickness of the supports will be determined by the desired load bearing characteristics. The present invention provides a module which is strong, light weight and does not require additional lighting elements in the module.

I claim:

1. A display module for suspension between grid members of a suspended ceiling, the module comprising a light transmitting trough formed by two relatively planar panels that angle outwardly and are joined by a bottom member and two end closures, the planar panels define a trough length and the end closures define a trough width, the trough width is less than one-third of the trough length, the planar panels include upper and lower attachment means for retaining interchangeable indicia panels, the lower attachment means is further comprised of a pair of arms having upper and lower portions that are substantially parallel to a respective planar panel, the upper portion of each arm forms a channel in conjunction with the respective planar panel to retain an indicia panel and the lower portions of the arms extend inwardly toward each other and terminate in close proximity to define a channel opening; the lower portions have flanges that extend away from the channel opening and form a lower channel therebetween, non-aligned projections on the flanges define a serpentine path within the lower channel.

* * * * *